US011096473B2

(12) United States Patent
Evans et al.

(10) Patent No.: US 11,096,473 B2
(45) Date of Patent: Aug. 24, 2021

(54) INSERT FOR PLIABLE MAGAZINE CARRIER

(71) Applicant: Edge-Works Manufacturing Company, Burgaw, NC (US)

(72) Inventors: Scott V. Evans, Jacksonville, NC (US); David Pomeroy, Tamarac, FL (US)

(73) Assignee: Edge-Works Manufacturing Company, Burgaw, NC (US)

( * ) Notice: Subject to any disclaimer, the term of this patent is extended or adjusted under 35 U.S.C. 154(b) by 0 days.

(21) Appl. No.: 16/935,863

(22) Filed: Jul. 22, 2020

(65) Prior Publication Data

US 2021/0022487 A1 Jan. 28, 2021

Related U.S. Application Data

(60) Provisional application No. 62/876,840, filed on Jul. 22, 2019.

(51) Int. Cl.
*A45F 5/02* (2006.01)

(52) U.S. Cl.
CPC ..... *A45F 5/022* (2013.01); *A45F 2200/0591* (2013.01)

(58) Field of Classification Search
CPC .. F42B 39/02; A45F 5/022; A45F 2200/0591; F41A 9/65; F41A 9/54; F41A 9/84
USPC ..... D3/262; D22/108; 206/3; 224/931, 245, 224/239
See application file for complete search history.

(56) References Cited

U.S. PATENT DOCUMENTS 915,206 A * 3/1909 McCord ..... A24F 27/00 206/101
2,235,833 A * 3/1941 Garand ..... F41A 9/84 42/88
2,566,569 A * 9/1951 Jensen ..... F42B 39/02 224/239
2,756,913 A * 7/1956 Oswald ..... F42B 39/002 221/310
2,763,411 A * 9/1956 Werner ..... F42B 39/02 224/199
3,669,249 A * 6/1972 Foster ..... F41A 9/84 206/3
3,769,733 A * 11/1973 Nelson ..... F41A 9/85 42/89
5,174,482 A * 12/1992 Rogers ..... F42B 39/02 221/185
5,450,947 A * 9/1995 Sgueglia, Sr. ..... B65D 85/20 206/3
6,076,715 A * 6/2000 Easter ..... F41A 23/18 224/149
6,145,654 A * 11/2000 Loghman ..... B65D 83/384 206/37
6,874,618 B1 * 4/2005 Cragg ..... F42B 39/02 206/3
7,780,048 B2 * 8/2010 Howell ..... A41D 13/0012 224/242

(Continued)

*Primary Examiner* — Justin M Larson
(74) *Attorney, Agent, or Firm* — Intellectual Property Consulting, LLC; Stephen M. Kepper

(57) ABSTRACT

A semi-rigid pocket insert for holding an ammunition magazine or clip within a pliable magazine carrier is provided. The pocket insert comprises opposing walls, a base, and a slip-resistant liner on the interior and exterior surface of the walls. The walls further comprise flared top ends.

19 Claims, 4 Drawing Sheets

(56) References Cited

U.S. PATENT DOCUMENTS

| | | | | |
|---|---|---|---|---|
| 8,011,544 | B1 * | 9/2011 | Howell | F42B 39/02 224/668 |
| 9,459,072 | B2 * | 10/2016 | Kafer | F41C 23/16 |
| 9,668,568 | B2 * | 6/2017 | Evans | A45F 5/00 |
| 9,677,865 | B2 * | 6/2017 | Rogers | A45F 5/022 |
| 2016/0003598 | A1 * | 1/2016 | Gadams | F42B 39/02 206/3 |
| 2019/0154390 | A1 * | 5/2019 | DiLeo | F41A 35/02 |
| 2020/0087040 | A1 * | 3/2020 | Evans | B65D 43/0214 |
| 2021/0022487 | A1 * | 1/2021 | Evans | F42B 39/00 |

* cited by examiner

INSERT FOR PLIABLE MAGAZINE CARRIER

RELATED APPLICATIONS

This application claims priority to U.S. Provisional Application No. 62/876,840 filed Jul. 22, 2019. The entire contents of the above application are hereby incorporated by reference as though fully set forth herein.

FIELD

The invention relates to ammunition magazine carriers. More specifically, the invention is directed to a pocket insert for pliable magazine carriers.

BACKGROUND

Soft, pliable, modular carriers are ubiquitous in the tactical gear industry. These carriers (or pouches) are pockets commonly used to carry rifle magazines and pistol clips. The carriers are often attached to the user's belt, harness or other clothing and may be removed to reconfigure the user's gear ensemble. The carriers are usually composed of two or four flexible walls and a base made from a pliable fabric, such as CORDURA®, with an open top end operable to receive ammunition magazines or clips.

As the magazine or clip is inserted into the carrier, the fabric material typically flexes and creates a semi-secure hold on the magazine or clip. Likewise, when the magazine or clip is removed or absent from the carrier, the fabric material contracts to its "un-flexed" original position.

Trouble often arises during insertion of the magazine or clip. Before inserting the magazine or clip, the user must manually stretch the open top end of the carrier to accommodate the magazine or clip. This can be a cumbersome exercise, requiring the user to focus all attention and use both hands to insert a magazine or clip. Another problem is the magazine may get caught on the fabric which slows insertion, causes the fabric to wear and become torn, and may cause the magazine carrier to fail. For a soldier or emergency responder who is required to assemble tactical gear in a moment's notice, the time required and degree of difficulty in loading and unloading magazines or clips can be crucial to a successful mission.

Another problem arises while the magazine is stowed away in these carriers; often, the user's movements may cause the magazine to fall out of the carrier due to a lack of friction between the magazine and the fabric of the carrier. Dropping or losing magazines can be dangerous for several reasons. Emergency responders are trained not to drop or lose magazines in public, particularly full magazines, because live ammunition may be used for criminal purposes or harm those not properly trained to use it. It can be life threatening if, for example, an emergency responder or soldier reaches for a full magazine during combat only to find an empty carrier. Moreover, a dropped magazine could become soiled and cause the user's weapon to jam, which could endanger the user.

In addition, emergency responders and soldiers often benefit from the ability to carry full magazines that do not make noise while the user moves, as stealth operations are typically preferred. The lack of sufficient friction between the metallic surface of the magazines and the fabric of the carriers tends promote rattling of the magazines within these carriers.

Accordingly, there is a need for an insert device that can be easily installed into these soft, pliable carriers, to provide enhanced retention capabilities, facilitate easy insertion of a magazine or clip into the pocket, and improved noise suppression.

BRIEF SUMMARY OF THE INVENTION

The following embodiments thereof are described and illustrated in conjunction with systems, machines and methods which are meant to be exemplary and illustrative, and not limiting in scope. In various embodiments, one or more of the above-described problems have been reduced or eliminated, while other embodiments are directed to other improvements.

The present invention meets the aforementioned needs by providing a pocket insert comprising opposing walls and a base with an open top end operable for receiving an ammunition magazine or clip. The walls and the base may be formed from a single length of semi-rigid material bent upon itself approximately midway between its ends to form a type of U-bend, from which extends two opposing walls upward from the bottom base. The interior and exterior surfaces of the opposing walls further comprise a slip-resistant lining which, in a preferred embodiment, has been overmolded to the pocket insert.

In an alternative embodiment, the top-ends of each wall may be slightly flared outward to increase insertion tolerance and ease insertion of the magazine or clip. In yet another embodiment, the walls are biased away from each other, which will ensure a firm fitting within the pliable carrier when the walls are compressed inward to fit within the carrier.

DETAILED DESCRIPTION

Figure 1:
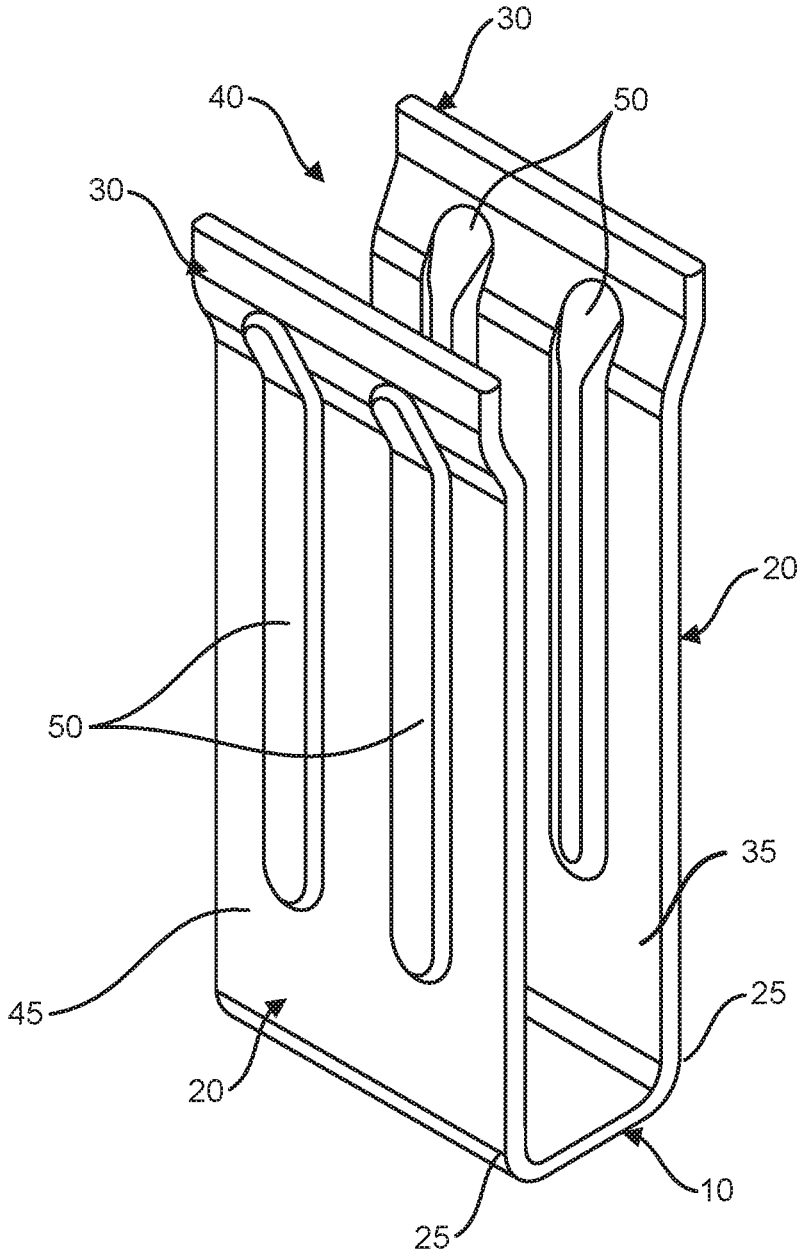
FIG. 1 is a perspective view of a preferred embodiment of the invention.

As depicted in FIG. 1, the pocket insert comprises a single length of semi-rigid material bent upon itself approximately midway between its ends to provide a U-bend from which a base 10 is formed with two opposing walls 20 extending from each end of the base 10. Each wall has a top end 30 that is distal to the base 10 and a bottom end 25 that is proximal to the base. It is anticipated that the walls 20 and base 10 may be separate components that are secured together by molding, welding, or using attachment means known in the art. The walls 20 and the base 10 are operable to fit within a typical magazine pouch or carrier having opposing walls and opposing sides with a bottom that collectively form a pocket for receiving an ammunition magazine or clip. The walls 20 may be substantially perpendicular to the base 10, or alternatively, for the preferred embodiment, the walls 20 are slightly biased away from each other to facilitate a more secure fitting when the pocket insert is inserted into the magazine carrier.

Optionally, in order to facilitate easier insertion of the magazine into the pocket insert and surrounding magazine (or clip) pouch or carrier, the top ends 30 of the walls 20 are flared outwards away from the walls 20, which creates an open end 40 that facilitates easier insertion of a desired ammunition magazine (not shown) into the clip insert and surrounding carrier.

Figure 2:
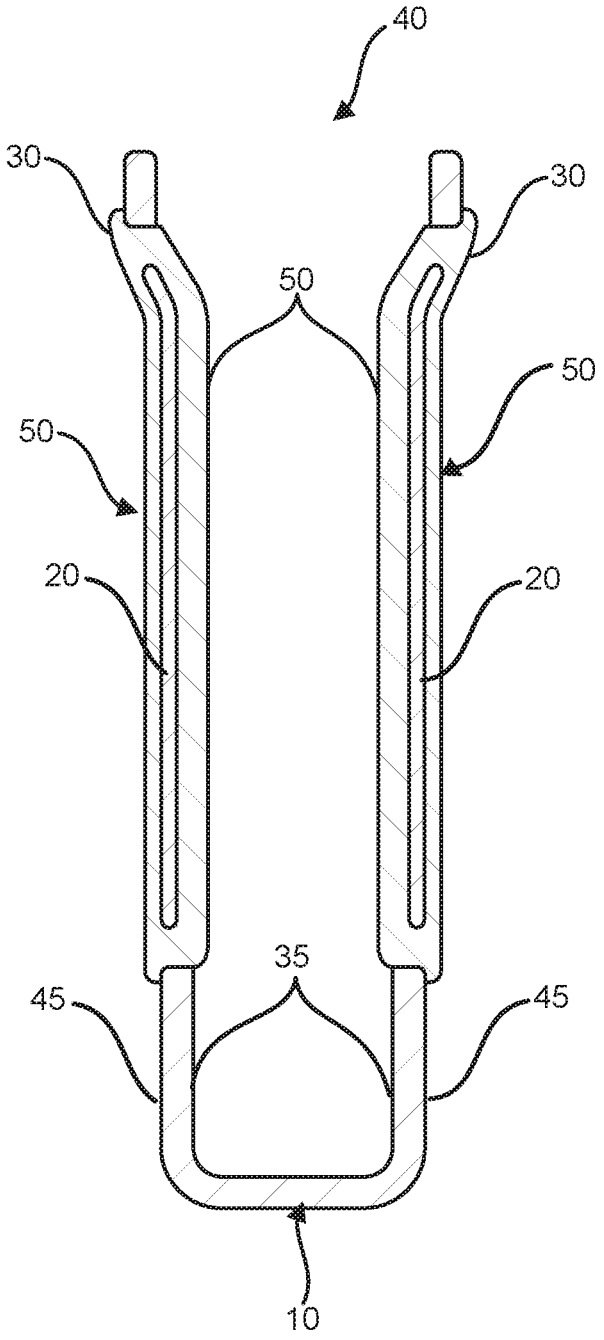
FIG. 2 is a cross-sectional side view of a preferred embodiment of the invention.
Figure 3:
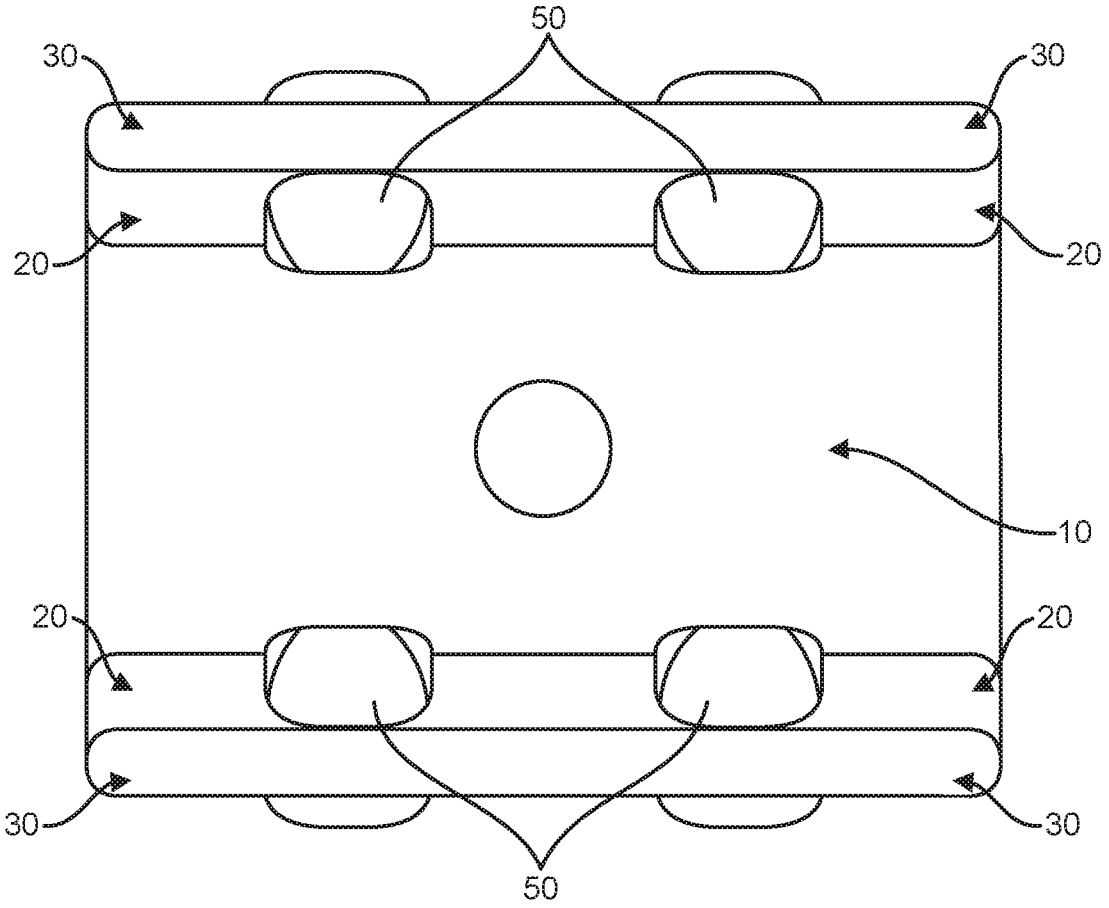
FIG. 3 is a top view of a preferred embodiment of the invention.

Turning to FIGS. 1-3, each wall 20 has an interior surface 35 and exterior surface 45. Either or both surfaces includes a slip resistant lining 50. As shown in FIG. 3, the slip-resistant liner 50 protrudes from the interior 35 and exterior surfaces 45 of the walls 20. The protruding slip-resistant lining 50 on the interior surface 35 operates to grip and secures the inserted ammunition magazine or clip within the pocket insert. The additional friction created by the slip-resistant linings 50 on the interior surface 35 further prevents inadvertent expulsion of magazine from the pocket insert.

Second, in similar fashion, the protruding slip-resistant lining 50 on the exterior surface 45 operates to secure the pocket insert to the surrounding magazine carrier or pouch. The biasing outward of the walls 20 operates as an additional measure to secure the pocket insert within the magazine carrier by forcing the exterior surface 45 of walls 20 and the protruding slip-resistant lining 50 upon the surrounding carrier.

Figure 4:
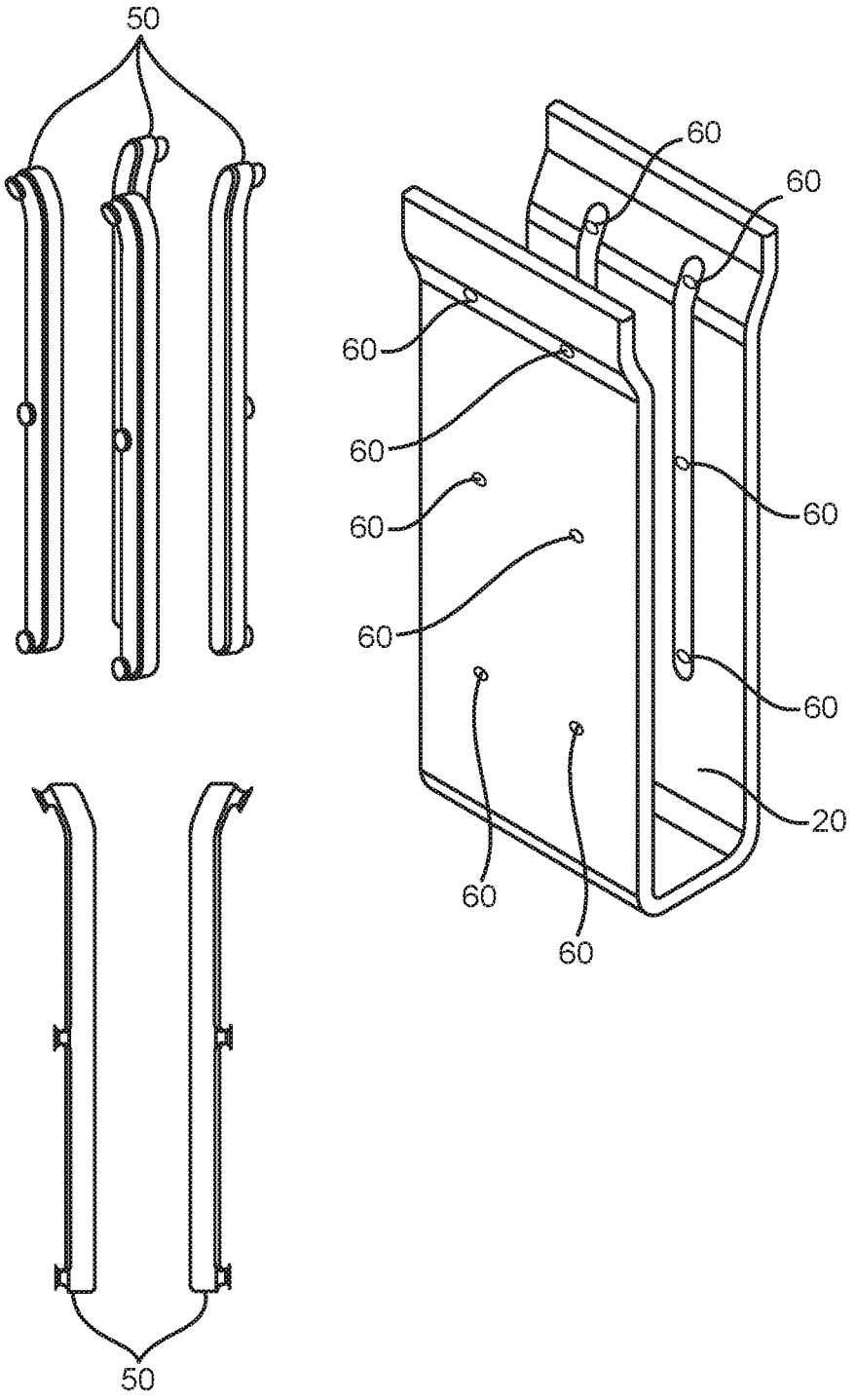
FIG. 4 is an exploded perspective view of a preferred embodiment of the invention showing the overmolded slip-resistant liners apart from the body of the pocket insert.

Turning to FIG. 4, an exploded view of the pocket insert is shown with the slip-resistant linings 50 separate and apart from the body of the pocket insert. This figure illustrates how the preferred embodiment uses overmolding to secure the slip-resistant liners to the interior 35 and exterior surface 45 of the walls 20 of the pocket clip. Through the incorporation of apertures 60 along the walls 20, slip-resistant material is then overmolded through the apertures 60 and over the surfaces 34, 45 of the walls 20 to creates a stronger and more durable bond than typical adhesives. The overmolding process creates both a chemical bond and mechanical bond between the slip resistant lining 50 and the material used on the body of the pocket insert. The mechanical bond is created by having the slip resistant lining 50 integrally connected on both sides of the wall 20 through the apertures 60. The chemical bond is created during the injection molded process when material of the slip resistant lining 50 and the material of the wall 50 are melted and fused together. Although this is the preferred means of attachment for the slip-resistant lining 50 to the walls 20 of the pocket insert, other means of attachment known in the art can be used, including the use of adhesives, sewing, or glue to bond two materials together. The slip-resistant lining 50 is preferably made from a synthetic polymer such as injected molded TPE (thermoplastic elastomer), TPV (thermoplastic vulcanizate), or TPU (thermoplastic polyurethane); however, other rubber-like materials may be used.

The pocket insert may be made from a group materials with rigid or semi-rigid properties such that that the pocket insert holds its shape when the pocket insert is placed within a soft, pliable, fabric-based modular carrier. Some examples of these materials include nylon, polypropylene, or other materials with semi-rigid properties.

For the purposes of promoting and understanding of the principles of the invention, reference has been made to the preferred embodiments illustrated in the drawings, and specific language has been used to describe these embodiments. However, this specific language intends no limitation of the scope of the invention, and the invention should be construed to encompass all embodiments that would normally occur to one of ordinary skill in the art. The particular implementations shown and described herein are illustrative examples of the invention and are not intended to otherwise limit the scope of the invention in any way.

For the sake of brevity, conventional aspects of the system (and components of the individual operating components of the system) may not be described in detail. Furthermore, the connecting lines, or connectors shown in the various figures presented are intended to represent exemplary functional relationships and/or physical or logical couplings between the various elements. It should be noted that many alternative or additional functional relationships, physical connections or logical connections may be present in a practical device. Moreover, no item or component is essential to the practice of the invention unless the element is specifically described as "essential" or "critical." Numerous modifications and adaptations will be readily apparent to those skilled in this art without departing from the spirit and scope of the present invention.

What is claimed is:

1. A pocket insert for a pliable ammunition magazine carrier comprising:

two opposing walls, each wall having an interior surface, an exterior surface, a top end and a bottom end, wherein the walls are biased away from each other;

a slip-resistant lining disposed on the interior surface of the walls; and a base connected to the bottom ends of the walls, wherein the opposing walls and base form an interior cavity with an open top operable to fit within a pliable magazine carrier.

2. The pocket insert of claim 1, wherein the top ends of the opposing walls are flared.

3. The pocket insert of claim 1, wherein the opposing walls and base form a single, contiguous body.

4. The pocket insert of claim 1, wherein the slip-resistant lining is selected from the group of materials comprising TPE, TPV, or TPU.

5. The pocket insert of claim 1 further comprising a slip resistant lining disposed on the exterior surface of the walls.

6. The pocket insert of claim 5, wherein the slip-resistant lining is selected from the group of materials comprising TPE, TPV, or TPU.

7. The pocket insert of claim 1 wherein the walls comprise a plurality of apertures operable to allow the slip-resistant lining to be overmolded to the walls.

8. A pocket insert comprising:

two opposing walls, each wall having an interior surface, an exterior surface, a top end and a bottom end;

a slip-resistant lining disposed on the interior surface and exterior surface of the walls, wherein the walls comprise a plurality of aperture operable to allow the slip-resistant lining to be overmolded to the walls; and a base connected to the bottom ends of the walls, wherein the opposing walls and base form an interior cavity with an open top, the pocket clip is operable to fit within a pliable magazine carrier.

9. The pocket insert of claim 8, wherein the top ends of the opposing walls are flared.

10. The pocket insert of claim 8, wherein the opposing walls and base form a single, contiguous body.

11. The pocket insert of claim 8, wherein the slip-resistant lining is selected from the group of materials comprising TPE, TPV, or TPU.

12. The pocket insert of claim 8, wherein the walls are biased away from each other.

13. A pocket insert for a pliable ammunition magazine carrier comprising: two opposing walls, each wall having an interior surface, an exterior surface, a top end and a bottom end; a slip-resistant lining disposed on the interior surface of the walls, wherein the walls comprise a plurality of apertures operable to allow the slip-resistant lining to be overmolded to the walls; and a base connected to the bottom ends of the walls, wherein the opposing walls and base form an interior cavity with an open top operable to fit within a pliable magazine carrier.

14. The pocket insert of claim 13, wherein the top ends of the opposing walls are flared.

15. The pocket insert of claim 13, wherein the opposing walls and base form a single, contiguous body.

16. The pocket insert of claim 13, wherein the slip-resistant lining is selected from the group of materials comprising TPE, TPV, TPU.

17. The pocket insert of claim 13, wherein the walls are biased away from each other.

18. The pocket insert of claim 13 further comprising a slip resistant lining disposed on the exterior surface of the walls.

19. The pocket insert of claim 18, wherein the slip-resistant lining is selected from the group of materials comprising IPE, TPV, or TPU.

* * * * *